United States Patent [19]

Pan et al.

[11] 4,421,229

[45] Dec. 20, 1983

[54] DOUBLE TRAY CASE

[75] Inventors: Peter N. Y. Pan, Minnetonka; Gregory M. Fulkerson, Maple Plain, both of Minn.

[73] Assignee: Paxall, Inc., Chicago, Ill.

[21] Appl. No.: 278,213

[22] Filed: Jun. 29, 1981

[51] Int. Cl.[3] ..... B65D 5/50; B65D 5/54

[52] U.S. Cl. ..... 206/44 R; 206/602; 229/27; 229/42

[58] Field of Search ..... 206/602, 44 R, 606, 206/627; 229/27, 42

[56] References Cited

U.S. PATENT DOCUMENTS

| | | | |
|---|---|---|---|
| 1,647,604 | 11/1927 | Bucher | 229/15 |
| 2,852,177 | 9/1958 | Frasch | 229/15 |
| 3,199,762 | 8/1965 | Coons | 229/27 |
| 3,314,587 | 4/1967 | Johnson | 229/27 |
| 3,390,810 | 7/1968 | Schneeweiss | 220/115 |
| 3,404,806 | 10/1968 | Richardson | 229/27 |
| 3,552,636 | 1/1971 | Geary | 229/51 |
| 3,677,458 | 7/1972 | Gosling | 229/27 |

*Primary Examiner*—William T. Dixson, Jr.
*Assistant Examiner*—Brenda J. Ehrhardt
*Attorney, Agent, or Firm*—Fitch, Even, Tabin & Flannery

[57] ABSTRACT

A case is provided for carrying two tiers of product which may be opened to form two tray portions each containing a single tier of product. The case has horizontally split ends, one horizontally separable sidewall and a central horizontal partition with flaps that extend through the split ends, some of which are secured to the upper portion of the ends and some of which are secured to the lower portions of the ends. The case is opened by splitting the separable sidewall, detaching the flaps from the lower portions of the ends and swinging the upper tray portion away from the lower tray portion.

14 Claims, 8 Drawing Figures

DOUBLE TRAY CASE

The present invention is directed to a container for packing two tiers of product and more particularly to a package which may be opened to form a pair of side-by-side trays.

BACKGROUND OF THE INVENTION

For efficiency of packing, it is desirable to package a large number of items in a single container. For the recipient, however, it is often more convenient to have small packages so that items not needed at the time may be stored in their shipping case. The shipping case described herein is designed for packaging two tiers of products and openable to provide two trays of items.

SUMMARY OF THE INVENTION

A shipping container or case for carrying two tiers of product has a separable sidewall, ends divided by horizontal slits thereacross and a center partition disposed between the top and the bottom of the case having flaps extending through the horizontal slits, some of which are secured to the upper portions of the ends and some of which are secured to the lower portions of the ends. To open the case, the separable sidewall is opened, the seal between the lower portions of the ends and the flaps secured thereto is broken, and the upper portion of the case is pivoted backward to provide two trays, each carrying a tier of product.

DETAILED DESCRIPTION OF THE PREFERRED EMBODIMENT

Figures 1, 2, 3, 4, 5, 6, 7, 8:
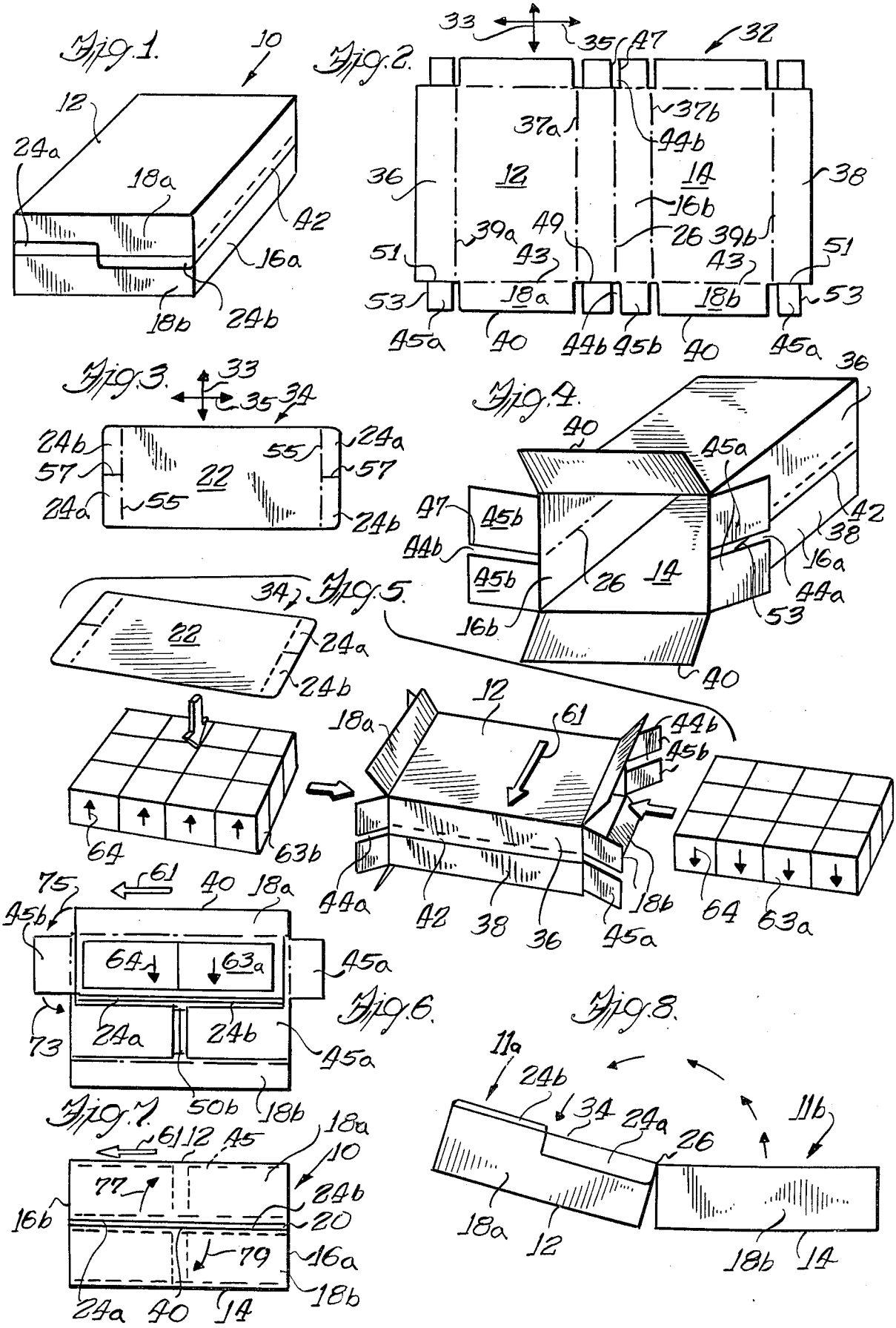
FIG. 1 is a perspective view of an assembled partitioned case embodying various features of the present invention.
FIG. 2 is a plan view of a blank for forming the body of the case of FIG. 1.
FIG. 3 is a diminutive plan view of a blank for forming the partition of the case of FIG. 1.
FIG. 4 is a perspective view of an open ended tubular box formed from the blank of FIG. 2.
FIG. 5 is a perspective view illustrating the loading of the tubular box of FIG. 4.
FIG. 6 is an end elevation view of the case illustrating the closing of the ends of the loaded case.
FIG. 7 is an end elevation view of the case illustrating a further step in the closing of the case.
FIG. 8 is an elevation view illustrating the opening of the case shown in FIG. 1.

In accordance with the present invention, a container or case 10 (FIG. 1), which may be opened into a pair of side-by-side tray portions 11*a*,11*b* (FIG. 8), is provided having an upper panel 12, a lower panel 14 (FIG. 4), a pair of sidewalls 16*a*, 16*b*, one 16*a* of which is horizontally separable into two sections between the upper and lower panels, an upper end cover 18*a* and a lower end cover 18*b* at each end defining horizontal slits 20 (FIG. 7) therebetween and a center partition panel 22 (FIG. 3), parallel to and generally midway between the upper and lower panels, with glue flaps 24*a*, 24*b* hinged from each end, extending through the slits and secured to the end covers 18*a*, 18*b*, respectively. The case 10 may be opened by splitting the separable sidewall 16*a* and detaching the sealing flaps 24*b* from the lower end covers 18*b* to separate the tray portions and swinging the upper tray portion 11*a* away from the lower tray portion 11*b* along a horizontal hinge 26 (FIG. 4) through the other sidewall 16*b*. (While the filled case 10 may be shipped and stored in any orientation, it will be described, in reference to FIG. 1, in an orientation from which the case may be opened into the side-by-side tray portions 11.) The sealing flaps 24*a* are detached from the upper end covers 18*a* to remove the partition panel 22.

The case 10 is assembled from a pair of die-cut and scored blanks, including a blank 32 (FIG. 2) which forms the body of the case and the blank 34 (FIG. 3) which partitions the case. For ease of explanation, the blanks 32 and 34 are described herein as having a longitudinal dimension 33 and a transverse dimension 35, in reference to the arrows above FIGS. 2 and 3.

In the blank 32 for forming the rectangular case, the horizontal panels 12, 14, which form the top and bottom respectively of the assembled case 10, are hinged to the longitudinal edges 37*a*, 37*b*, respectively, of the sidewall panel 16*b* having the longitudinal line of weakness 26 thereacross generally centered between the horizontal panels. Means for forming the opposite sidewall 16*a* includes a first half sidewall panel 36 hinged to the outer longitudinal edge 39*a* of the top panel 12 and a second half sidewall panel 38 hinged to the outer longitudinal edge 39*b* of the bottom panel 14. The total transverse dimensions of the half sidewall panels 36, 38 is greater than the transverse dimension of the sidewall panel 16*b*, whereby outer portions of the half sidewall panels overlap when the blank 32 is folded to bring the opposite ends of the blank together for forming the manufacturer's joint 42 (FIG. 4).

The upper and lower end cover panels 18*a*, 18*b* are hinged along the transverse edges 43 of the horizontal panels 12, 14. The longitudinal dimensions of the end cover panels 18 are less than one half the transverse dimension of the sidewall panel 16*b* so that the outer transverse edges 40 of the end cover panels are spaced apart to form the slot 20 (FIG. 7) therebetween in the assembled case 10.

A pair of dust flaps 45*b* are hinged to each transverse edge 49 of the sidewall panel 16*b*. The inner or adjacent longitudinal edges 47 of each pair of dust flaps 45*b* are spaced apart to define a slot 44*b* therebetween which is generally centered relative to the transverse edge 49 of the sidewall panel 16*b* and which aligns with the slots 20 between the end covers 18*a*, 18*b* in the assembled case 10. Similarly, a dust flap 45*a* is hinged to each lateral edge 51 of each half sidewall panel 36, 38. The dust flaps 45*a* hinged to the half sidewall panels 36, 38 on each side of the blank 32 define pairs of flaps 45*a* which are positioned adjacent each other when the ends of the blank are joined together to form the manufacturer's joint 42. The outer longitudinal edges 53 of the dust flaps 45*a* of each pair are spaced from the score lines 39*a*, 39*b* joining the half sidewall panels 36, 38 and horizontal panels 12, 14, less than one half the transverse dimension of the sidewall panel 16*b* so that when the manufacturer's joint 42 is formed, the outer edges 53, which become adjacent each other, define a slot 44*a* (FIG. 4) therebetween generally centered relative to the horizontal panels 12, 14 and the transverse edge 51 to which the flaps are hinged, colinier with the slot 44*b* formed by the dust flaps 45*b* hinged to the sidewall panel 16*b* and aligned with the slot 20 between the corresponding end covers 18*a*, 18*b* in the assembled case 10.

The partition blank 34 includes the partition panel 22 and a plurality of glue flaps 24 hinged to the transverse edges 55 thereof. The partition panel 22 has dimensions substantially matched to those of the horizontal panels 12, 14 of the case blank 22, although its transverse dimension may be slightly less than the transverse dimension of the horizontal panels in order to fit easily between the sidewalls 16, and its longitudinal dimension may be slightly greater than the longitudinal dimension of the horizontal panels to extend through the end slots 20. As shown, a pair of glue flaps **24*a*, 24*b* are hinged to each transverse edge 55 of the partition panel 22, and the glue flaps at each end are separated from each other by central slits 57 perpendicular to the transverse edges 55** of the central panel.

The blank 32 is folded to bring the opposite ends together, and the ends are joined to form a manufacturer's joint. As one mode of accomplishing the joining of the ends, the blank 32 is doubled over along the score line **37*b*, hinging the bottom panel 14 to the sidewall panel 16*b*. A glue pattern is applied to the outer surface of the second half sidewall panel 38, and the upper half sidewall panel 36 is folded along its longitudinal score line 39*a* so that a portion of the first half sidewall panel 36** overlaps and seals with the second half sidewall panel resulting in a flat-folded side-seamed tubular configuration. The containers are stacked in their flat folded configuration for shipping and storage and outfolded at the loading site.

The case 10 is advantageously used to hold two tiers of product, such as arrays **63*a*, 63*b* shown in FIG. 5. Each array 63 includes a plurality of items in a particular vertical orientation as designated by the arrows 64. Two arrays 63 are packaged in the case 10 with the product in one array 63*b* upright and the product in the other array 63*a* inverted and with the arrays separated by the partition panel 22 so that when the case is opened by swinging the top tray portion 11*a* away from the bottom tray portion 11*b***, both product arrays will be in their upright orientation.

A variety of sequences may be used to load the tubular configuration. In a typical loading sequence (represented in FIG. 5), the partition blank 34 is laid over a product-filled array **63*b* and inserted therewith from one open end of the tubular configuration. Thereafter, a second array 63*a* in inverted orientation is loaded into the opposite end of the tubular configuration. Alternatively, the two arrays 63 may be loaded together with the partition blank 34** sandwiched therebetween, or the first array may be inserted followed by insertion of the partition blank carrying the second array thereontop.

After loading, the tubular configuration is carried by a conveyer in the direction of the arrow 61 (FIGS. 6 and 7) and the dust flaps 45 are plowed inward, as shown by the arrows 73 (FIG. 6), a glue pattern is applied to the inner surface of the end cover panels 18, and the end cover panels are plowed inward to seal with the dust flaps 45 as represented by the arrows 75 (FIG. 6). At this time, the glue flaps 24 of the partition blank 34 extend through the slits 20 between the upper and lower end cover panels 18. Glue patterns are applied to the upper surfaces of one of the glue flaps **24*a* at each end, and the flaps are plowed upward as indicated by the arrows 77 (FIG. 7) to seal with the upper end covers 18*a*. Glue patterns are then applied to the under surfaces of the other glue flap 24*b* which are plowed downward, as indicated by the arrow 79, to seal with the lower end covers 18*b*. It is preferred that a pair of diagonally positioned glue flaps 24*a*, 24*b* are glued to the upper end covers 18*a* and lower end covers 18*b*, respectively, to provide better support for the upper product array 63*b*** as the case is split open.

The package may be conveniently opened (FIG. 8) into the two tray portions 11 with the arrays of product 63 in their upright orientation. The case 10 is laid flat on its bottom panel 14, the manufacturers joint 42 formed by the sidewall halves 36, 38 is split and the glue flaps **24*b*, which are cemented to the lower end covers 18*b*, are detached therefrom to divide the package into the two tray portion 11*a*, 11*b*. As shown in FIG. 8, the upper tray portion 11*a* is pivoted away from the lower tray portion 11*b* along the horizontal hinge 26 to where the top panel 12 lies flat with the upper array of product 63*a* inverted back to its upright position. During pivoting, the seal between the glue flaps 24*a* and the upper end covers 18*a* holds the upper teir of product 63*a* in the upper tray portion 11*a*. When it is desired to use the product in the upper tray portion 11*a*, the glue flaps 24*a* are detached from the upper end covers 18*a* to remove the partition 34 exposing the upper tier of product 63*a*. The case 10, of course, may similarly be opened from its inverted position which will also orientate the both tiers of product 63** in their upright positions.

Cases, according to the invention, may be made of any size. For heavier items, the cases may be made of single-wall corrugated fiberboard. For lighter items, the cases may be made of paperboard.

The particular order of folding, gluing and loading may be varied according to the packaging needs and according to the machinery used to form the complete package. For example, two holders 63 with the center partition blank 34 sandwiched therebetween may be loaded from one end of the tubular configuration. Two arrays 63 of product may be placed respectively on the bottom panel **18*b* of the body blank 32 with the partition blank 34 sandwiched therebetween and the body blank 32** wrapped around the sandwiched product arrays.

While the invention has been described in terms of certain preferred embodiments, modifications obvious to one with ordinary skill in the art may be made without departing from the scope of the invention. Where the strength requirements are not high, a case may be formed without use of the dust flaps 30 relying only on the bond between the glue flaps 24 with the end covers 18 to hold the case together. The separable sidewall **16*a* may be formed as a unitary panel hinged from the longitudinal edge 39*a* or 39*b* of either the top or bottom panel and have a glue flap hinged to its opposite longitudinal edge to overlap and seal with the other horizontal panel. The hinged sidewall 16*b* may include a tear strip closely adjacent the hinge 26 to allow the joined tray portions 11** to be separated.

Various features of the invention are set forth in the following claims.

What is claimed is:

1. A double-tray package comprising:

a top horizontal panel, a bottom horizontal panel and a pair of sidewalls each connected to said top and said bottom panels, one sidewall being horizontally separable and the other sidewall having a horizontal line of weakness extending the length thereof, vertical upper end cover means and vertical lower end cover means at each end of said package defining an open horizontal slit entirely across each end of said package, and a central partition means having a transverse dimension substantially equal to the transverse dimension of said horizontal panels in order to fit between sidewalls and having glue flaps at each end thereof that extend through said horizontal slits and being folded vertically upward and secured to said upper end cover means and glue flaps at each end that extend through said horizontal slits being folded vertically downward and secured to said lower end cover means, said package having a first tier of product on one side of said central partition means and a second tier of product on the other side of said central partition means, whereby said package may be opened into a pair of joined trays by breaking said separable sidewall and detaching said lower end cover means from said glue flaps secured thereto.

2. A package according to claim 1 wherein said partition means has a pair of glue flaps at each end, one of which is secured to said upper end cover means and one of which is secured to said lower end cover means.

3. A package according to claim 1 wherein said upper end cover means are hinged to said top panel and said lower end cover means are hinged to said bottom panel.

4. A package according to claim 3 also including a pair of dust flaps hinged to each end of each of said sidewalls, the flaps of each of said pairs spaced apart to allow said glue flaps to extend therebetween.

5. A package according to claim 1 wherein said horizontal slits are disposed midway between said upper and said lower panels.

6. A package according to claim 1 wherein said first sidewall includes an upper half and a lower half and a manufacturers joint between overlapping portions thereof.

7. In combination a blank for forming an open ended rectangular container comprising:

a sidewall panel and a pair of horizontal panels hinged to the longitudinal edges thereof, said sidewall panel having a line of weakness extending longitudinally thereacross generally midway between said horizontal panels, opposite sidewall panel means hingedly connected to the longitudinal edge of at least one of said horizontal panels, said opposite sidewall panel means having a portion for overlapping the opposite end of said blank for forming a manufacturer's joint therewith, end cover panels hinged to the transverse edges of said horizontal panels, said end cover panels each having a longitudinal dimension less than one half the transverse dimension of said sidewall panel, a pair of dust flaps hinged to each transverse edge of said sidewall panel, the longitudinal edges of said pairs of dust flaps adjacent each other spaced apart to provide an open slit entirely across each end of the container generally centered along the transverse edge of said sidewall panel, a pair of dust flaps hinged to each transverse edge of said opposite sidewall panel means, the longitudinal edges of each of said pair of dust flaps, which are to be adjacent each other when the manufacturer's joint is formed, positioned to form a slit therebetween generally centered relative to said horizontal panels when the manufacturer's joint is formed, and a second blank for forming an interior partition, said second blank having a partition panel of dimensions substantially equal to the dimensions of said horizontal panels, and a plurality of glue flaps hinged to each transverse edge thereof, which glue flaps extend through said slits in the container.

8. A combination according to claim 7 wherein said opposite sidewall panel means consists of a first half sidewall panel hinged to one of said horizontal panels and a second half sidewall panel hinged to the other horizontal panel, said half sidewall panels each carrying a dust flap hinged to each transverse edge thereof, the outer longitudinal edge of each dust flap spaced from the score line connecting said half sidewall panel to said horizontal panel less than one half the transverse dimension of said sidewall panel.

9. A combination according to claim 8 wherein said half sidewall panels have a total transverse dimension greater than the transverse dimension of said sidewall panel.

10. A combination according to claim 9 wherein overlapping portions of the opposite ends of said first blank are joined to form a flat folded tubular configuration.

11. A combination according to claim 8 wherein said half sidewall panels are joined to form a flat folded, side-seamed tubular configuration.

12. A combination and a second blank according to claim 7 wherein said second blank has a pair of glue flaps extending from each transverse edge thereof.

13. A double-tray package comprising a top horizontal panel, a bottom horizontal panel, a first sidewall having a horizontal line of weakness extending the length thereof, and a second sidewall having an upper sidewall portion hinged to said top horizontal panel and a lower sidewall portion hinged to said bottom horizontal panel, said upper portion and said lower portion having a total vertical dimension greater than the vertical dimension of said first sidewall, overlapping regions of said upper portion and said lower portion being adhered together to form a manufacturer's joint that is horizontally separable, a vertical upper end cover portion hinged to said top horizontal panel at each end of said package and a vertical lower end cover portion hinged to said bottom horizontal panel at each end of said package, the vertical dimensions of each end cover being less than one half the vertical dimension of said first sidewall, whereby said end cover portions at each end define an open horizontal slit entirely across each end of said package centered between said top and bottom horizontal panels, a pair of dust flaps hinged to each end of each of said sidewalls, the dust flaps of each of said pairs being spaced apart to provide an open horizontal slot therebetween aligned with said open horizontal slit between said end cover portions, and a central partition means having a horizontal partition panel with longitudinal and transverse dimensions substantially equal to the longitudinal and transverse dimensions of said top and bottom horizontal panels and a pair of glue flaps at each end that extend through said open horizontal slits and slots, one glue flap at each end being folded upward and secured to said upper end cover portion and one glue flap at each end being folded downward and secured to said lower end cover portion.

14. A package according to claim 13 wherein diagonally positioned glue flaps are secured to said upper end closure portions.

* * * * *